US011300987B1

(12) United States Patent
Holland et al.

(10) Patent No.: US 11,300,987 B1
(45) Date of Patent: Apr. 12, 2022

(54) MANAGING ON-CHIP POWER RAIL BETWEEN INTERNAL POWER SUPPLY AND EXTERNAL POWER SUPPLY

(71) Applicant: Cirrus Logic International Semiconductor Ltd., Edinburgh (GB)

(72) Inventors: Kathryn R. Holland, Cedar Park, TX (US); Wesley L. Mokry, Austin, TX (US); Neel Pramanik, Austin, TX (US); Christian Larsen, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/214,310

(22) Filed: Mar. 26, 2021

Related U.S. Application Data

(60) Provisional application No. 63/124,211, filed on Dec. 11, 2020.

(51) Int. Cl.
*G05F 1/46* (2006.01)

(52) U.S. Cl.
CPC ..... *G05F 1/46* (2013.01)

(58) Field of Classification Search
None
See application file for complete search history.

(56) References Cited

U.S. PATENT DOCUMENTS 5,428,524 A * 6/1995 Massie ..... H02J 1/10 363/79
6,177,783 B1 * 1/2001 Donohue ..... H02J 1/001 323/272
9,742,393 B2 * 8/2017 Pavao-Moreira .... H03K 3/0377
10,673,423 B2 * 6/2020 Forghani-Zadeh ..... H03K 5/08

* cited by examiner

*Primary Examiner* — Thomas J. Hiltunen
(74) *Attorney, Agent, or Firm* — Jackson Walker L.L.P.

(57) ABSTRACT

A system may include an integrated circuit comprising an on-chip power supply and an internal power rail, a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, and a control circuit configured to monitor conditions associated with the on-chip power supply when the gate-controlled supply switch is transitioning between switch states and based on the conditions, control a rate of charging or discharging of a capacitance coupled to a gate of the gate-controlled supply switch.

24 Claims, 9 Drawing Sheets

MANAGING ON-CHIP POWER RAIL BETWEEN INTERNAL POWER SUPPLY AND EXTERNAL POWER SUPPLY

RELATED APPLICATION

The present disclosure claims priority to U.S. Provisional Patent Application Ser. No. 63/124,211, filed Dec. 11, 2020, which is incorporated by reference herein in its entirety.

FIELD OF DISCLOSURE

The present disclosure relates in general to electronic circuits, and more particularly, to electronic circuits having a current-limited on-chip power supply for regulating an on-chip power rail and an off-chip high-efficiency power supply.

BACKGROUND

As shown in FIG. 1, it may be desirable for an electronic device 10 to include an integrated circuit 12 having an internal on-chip power supply 14 (e.g., a low-dropout regulator or LDO) for regulating an on-chip power rail $VD_{CORE}$, and a high-efficiency power supply 16 external to integrated circuit 12 and coupled to the on-chip power rail via a supply switch 18 internal to integrated circuit 12. As also shown in FIG. 1, a load current $I_{LOAD1}$ may be drawn by components of integrated circuit 12 as represented by current sink 20 and a load current $I_{LOAD2}$ may be drawn by components of electronic device 10 external to integrated circuit 12 as represented by current sink 22. Electronic device 10 as shown in FIG. 1 may operate in two steady state modes of operation:

(a) a first mode in which supply switch 18 is open (e.g., deactivated, off, disabled) in which load current $I_{LOAD1}$ may be supplied from on-chip power supply 14; and (b) a second mode in which supply switch 18 is closed (e.g., activated, on, enabled) in which load current $I_{LOAD1}$ may be supplied from external power supply 16 and on-chip power supply 14 may be turned off or disabled.

The mode of operation may be chosen based on system power states, power consumption optimization, and/or other factors which are beyond the scope of this disclosure.

As electronic device 10 transitions between on-chip power supply 14 and external power supply 16, voltage excursions may be seen on power rail $VD_{CORE}$, as seen in FIGS. 2A and 2B, where the intended regulation voltage of the internal supply is $V_{REF}$. For example, as shown in FIG. 2A, when the external voltage $VD_{EXT}$ generated by external power supply 16 is greater than the internal voltage generated by on-chip power supply 14, the voltage on power rail $VD_{CORE}$ may undershoot upon opening of supply switch 18. As another example, as shown in FIG. 2B, when the external voltage $VD_{EXT}$ generated by external power supply 16 is less than the internal voltage generated by on-chip power supply 14, the voltage on power rail $VD_{CORE}$ may overshoot upon opening of supply switch 18 due to a sudden change in load. Under the same voltage conditions, the on-chip power supply 14 may momentarily supply load current $I_{LOAD2}$ during time regions of supply switch opening that the internal supply generating $VD_{CORE}$ is overdriving $VD_{EXT}$. As a further example, a limited bandwidth and slew rate of on-chip power supply 14 may lead to overshoot or undershoot of the voltage on power rail $VD_{CORE}$ on transitions of supply switch 18. As an additional example, a current $I_{SWITCH}$ through supply switch 18 may have a maximum safe current limit, and supply switch 18 may suffer damage or reliability issues if such current limit is exceeded.

Thus, such excursions on power rail $VD_{CORE}$ may potentially cause voltages and currents within integrated circuit 12 to operate outside of their operational bounds, which may damage components of integrated circuitry. Accordingly, systems and methods may be desired to reduce or eliminate such voltage excursions.

SUMMARY

In accordance with the teachings of the present disclosure, the disadvantages and problems associated with systems comprising an on-chip power supply coupled to an external power supply via a supply switch may be reduced or eliminated.

In accordance with embodiments of the present disclosure, a system may include an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, and a control circuit configured to monitor conditions associated with the on-chip power supply when the gate-controlled supply switch is transitioning between switch states and, based on the conditions, control a rate of charging or discharging of a capacitance coupled to a gate of the gate-controlled supply switch.

In accordance with these and other embodiments of the present disclosure, a method may be used in a system comprising an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed. The method may include monitoring conditions associated with the on-chip power supply when the gate-controlled supply switch is transitioning between switch states and, based on the conditions, controlling a rate of charging or discharging of a capacitance coupled to a gate of the gate-controlled supply switch.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
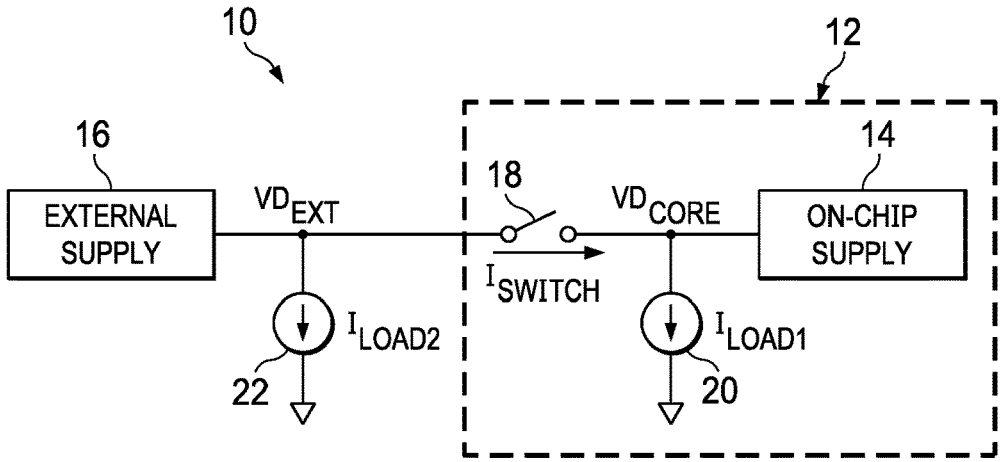
FIG. 1 (PRIOR ART)
FIG. 1 illustrates a block diagram of selected components of an example electronic device, as is known in the art.
Figure 2A:
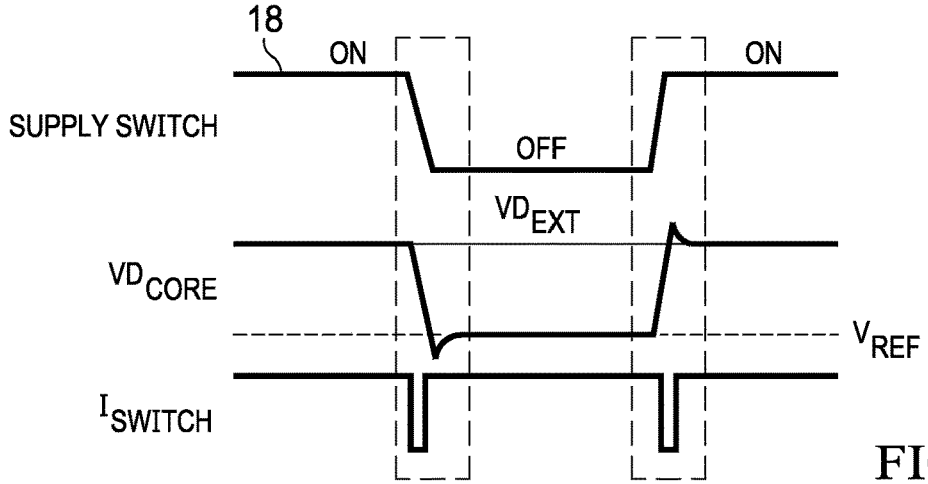
FIG. 2A (PRIOR ART)
FIGS. 2A and 2B illustrate graphs of example waveforms of selected voltages and currents within the electronic device shown in FIG. 1, as is known in the art.
Figure 2B:
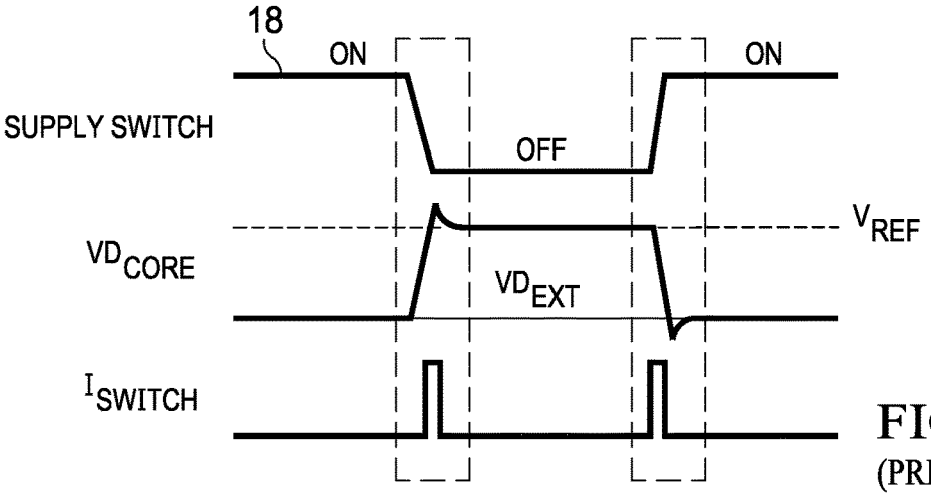
FIG. 2B (PRIOR ART)
Figure 3:
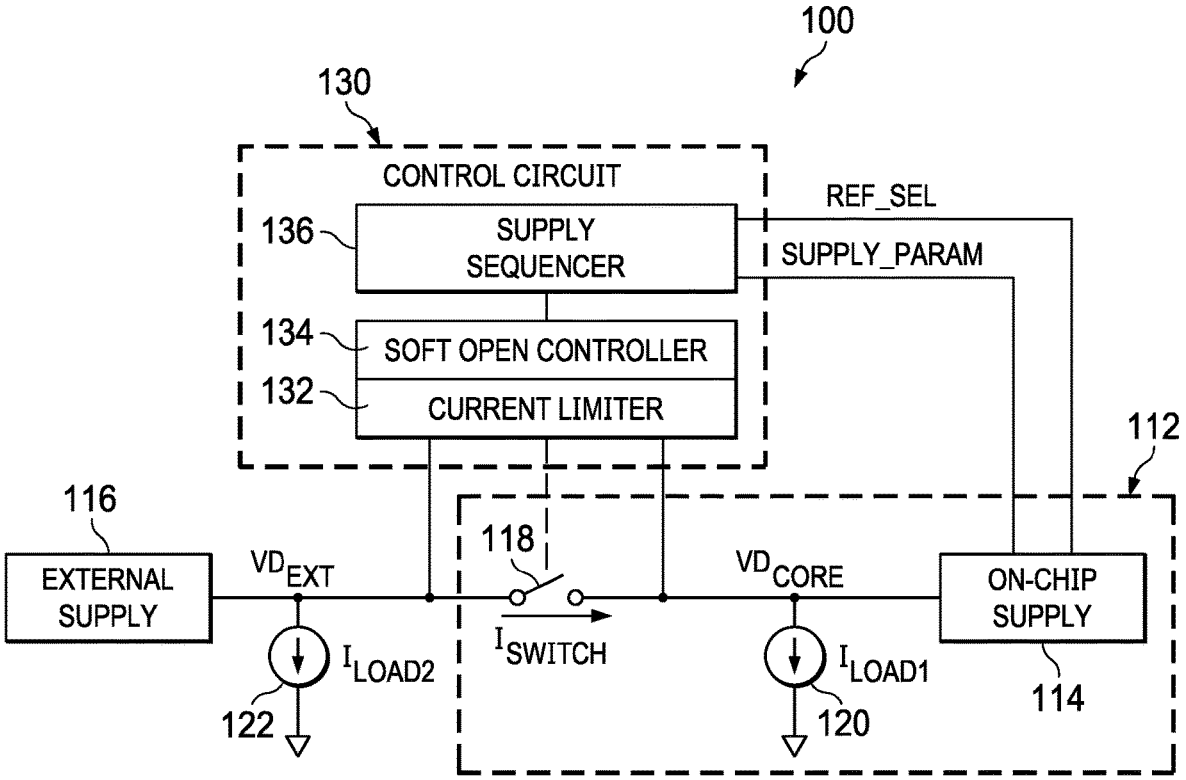
FIG. 3 illustrates a block diagram of selected components of an example electronic device, in accordance with embodiments of the present disclosure.

FIG. 3 illustrates a block diagram of selected components of an example electronic device 100, in accordance with embodiments of the present disclosure. As shown in FIG. 3, electronic device 100 may include an integrated circuit 112 having an internal on-chip power supply 114 (e.g., a low-dropout regulator or LDO) for regulating an on-chip power rail $VD_{CORE}$, and a high-efficiency power supply 116 external to integrated circuit 112 and coupled to the on-chip power rail via a supply switch 118 internal to integrated circuit 112. As also shown in FIG. 3, a load current $I_{LOAD1}$ may be drawn by components of integrated circuit 112 as represented by current sink 120 and a load current $I_{LOAD2}$ may be drawn by components of electronic device 100 external to integrated circuit 112 as represented by current sink 122.

As also shown in FIG. 3, and described in further detail below, electronic device 100 may include a control circuit 130 (e.g., a microcontroller unit) configured to generate a control signal for selectively opening and closing supply switch 118. As also described in further detail below, control circuit 130 may also be configured to generate control signals for controlling operation of on-chip power supply 114.

Electronic device 100 as shown in FIG. 3 may operate in two steady state modes of operation:

(a) a first mode in which supply switch 118 is open (e.g., deactivated, off, disabled) in which load current $I_{LOAD1}$ may be supplied from on-chip power supply 114; and (b) a second mode in which supply switch 118 is closed (e.g., activated, on, enabled) in which load current $I_{LOAD1}$ may be supplied from external power supply 116 and on-chip power supply 114 may be turned off or disabled.

The mode of operation may be chosen based on system power states, power consumption optimization, and/or other factors which are beyond the scope of this disclosure.

In operation, and as also described in greater detail below, control circuit 130 may operate to reduce or eliminate the disadvantages contemplated in the Background section of this disclosure. For example, to reduce or eliminate overshoot of voltage on on-chip power rail $VD_{CORE}$ in response to opening of supply switch 118 and/or to reduce or eliminate damage or reliability issues that may result from switch current $I_{SWITCH}$ exceeding a safe current limit, control circuit 130 may employ a current limiter 132 to limit switch current $I_{SWITCH}$. As another example, to reduce or eliminate undershoot of voltage on on-chip power rail $VD_{CORE}$ in response to opening of supply switch 118, control circuit 130 may include a soft-open controller 134 to perform a "soft opening" of supply switch 118. In addition or alternatively, to reduce or eliminate undershoot of voltage on on-chip power rail $VD_{CORE}$ in response to opening of supply switch 118, control circuit 130 may also control internal analog state variables which may be used to speed up a slow switch transition. As another example, to reduce or eliminate undershoot and/or overshoot of voltage on on-chip power rail $VD_{CORE}$ in response to transitions of supply switch 118, control circuit 130 may, via communication of a reference selection control signal REF_SEL and communication of supply parameters SUPPLY_PARAM to on-chip power supply 114, internally precondition on-chip power supply 114 based on knowledge of opening and closing events of supply switch 118. As also shown in FIG. 3, control circuit 130 may include a supply sequencer 136 configured to sequence switching of supply switch 118 and other components of electronic device 100.

Figure 4:
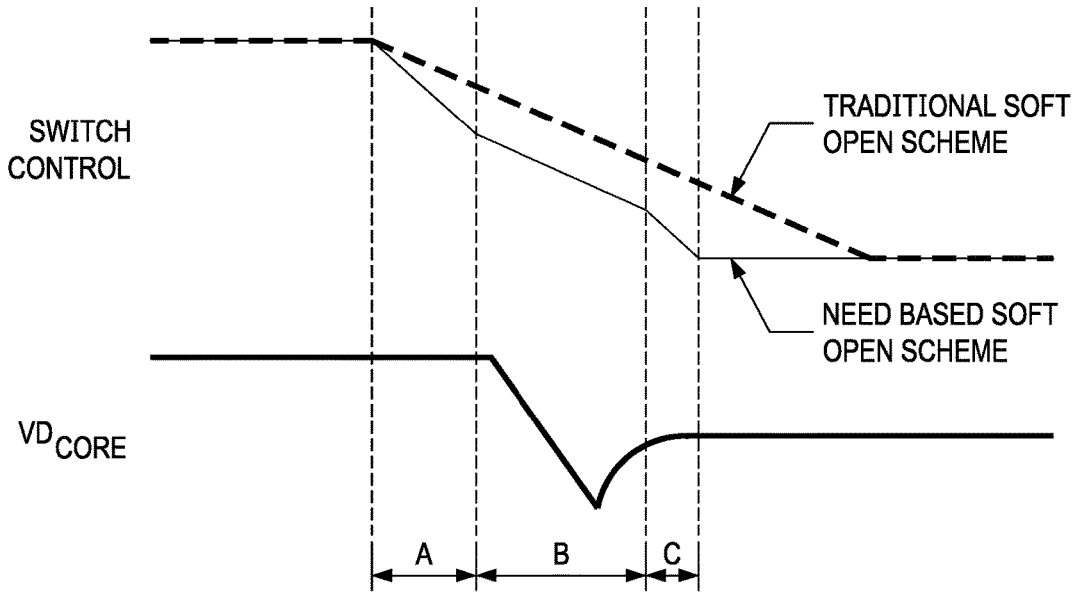
FIG. 4 illustrates graphs of example waveforms of a switch control signal and a rail voltage within the electronic device shown in FIG. 3, in accordance with embodiments of the present disclosure.

FIG. 4 illustrates graphs of example waveforms of a switch control signal $V_{GATE}$ for selectively enabling supply switch 118 and rail voltage $VD_{CORE}$, in accordance with embodiments of the present disclosure. An example waveform for switch control signal $V_{GATE}$ using a traditional soft-open scheme for supply switch 118 is shown in the example waveforms of switch control signal $V_{GATE}$ in FIG. 4. Although a traditional soft-open scheme may reduce overshoot/undershoot and peak current issues, the time required to make such open/close transitions may be too long for specific applications such as a power management integrated circuit. However, there may exist regions during the transition of switch control signal $V_{GATE}$ from closed to open which may be used to minimize the time required for transition by modulating the rate of charge or discharge of switch control signal $V_{GATE}$. Such regions are depicted in FIG. 4 as regions A, B, and C, and may be described as follows:

Region A: a time during which on-chip power rail $VD_{CORE}$ does not respond to opening or closing of supply switch 118.

Region B: a time during which electrical current supported by external power supply 116 being disengaged has fallen below a predetermined level.

Region C: a time during which switch current $I_{SWITCH}$ has fallen below a predetermined level.

Accordingly, soft-open controller 134 may be configured to perform a need-based soft-open scheme as shown in FIG. 4 to reduce soft-opening time used in traditional approaches. Soft-open controller 134 may perform such need-based soft-open scheme in any suitable manner. For example, in some embodiments, soft-open controller 134 may monitor on-chip power rail $VD_{CORE}$ and use feedback to drive switch control signal $V_{GATE}$. As a specific example, when on-chip power rail $VD_{CORE}$ is above a predetermined threshold voltage, soft-open controller 134 may increase a discharging rate from a capacitance coupled to the electrical node of switch control signal $V_{GATE}$. In addition or alternatively, soft-open controller 134 may monitor an electrical current output by either of on-chip power supply 114 or external power supply 116 and use feedback to drive switch control signal $V_{GATE}$. As a specific example, when the electrical current delivered from on-chip power supply 114 is above a predetermined threshold current, soft-open controller 134 may increase a discharging rate from a capacitance coupled to the electrical node of switch control signal $V_{GATE}$. In addition or alternatively, soft-open controller 134 may monitor switch current $I_{SWITCH}$ and use feedback to drive switch control signal $V_{GATE}$. As a specific example, when switch current $I_{SWITCH}$ is below a predetermined threshold current, soft-open controller 134 may increase a discharging rate from a capacitance coupled to the electrical node of switch control signal $V_{GATE}$. In addition or alternatively, soft-open controller 134 may utilize a timer-based approach wherein different discharge rates from a capacitance coupled to the electrical node of switch control signal $V_{GATE}$ are applied at various intervals based on known system behavior.

Figure 5A:
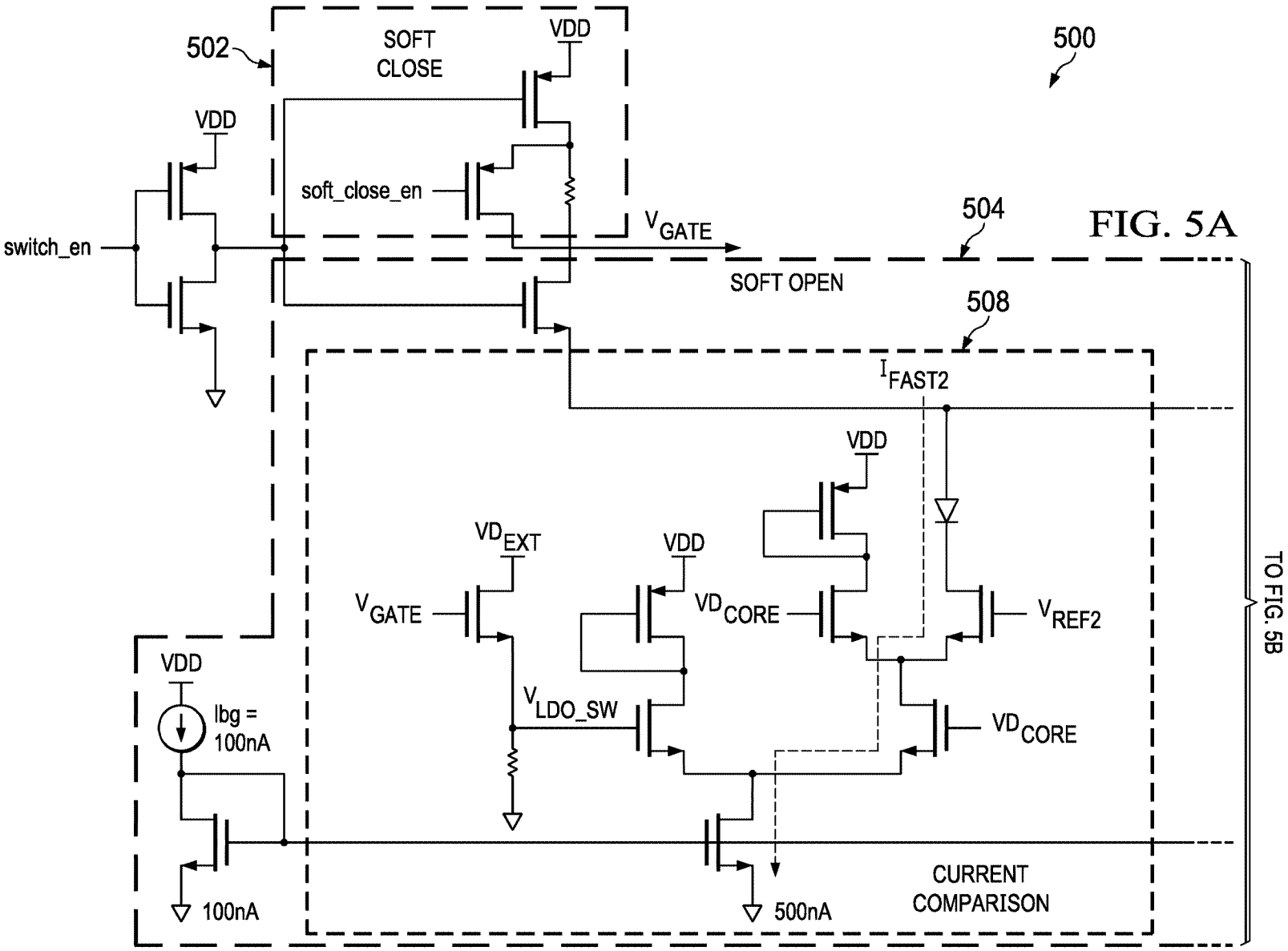
FIGS. 5A and 5B (which may collectively be referred to as FIG. 5 herein) illustrate a circuit diagram of selected components of a current-steering circuit for performing need-based soft-open and soft-close for a supply switch, in accordance with embodiments of the present disclosure.
Figure 5B:
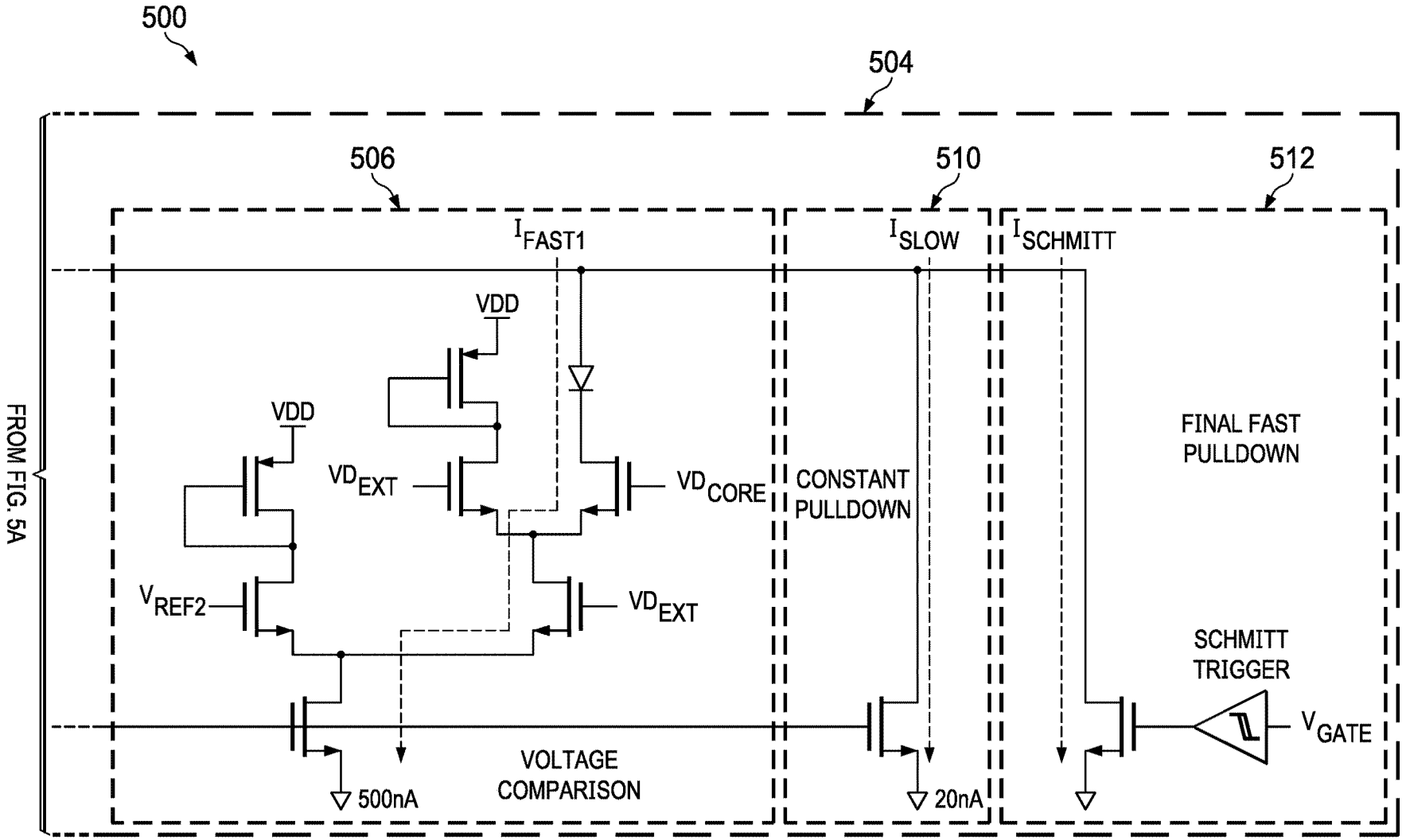
Figure 6:
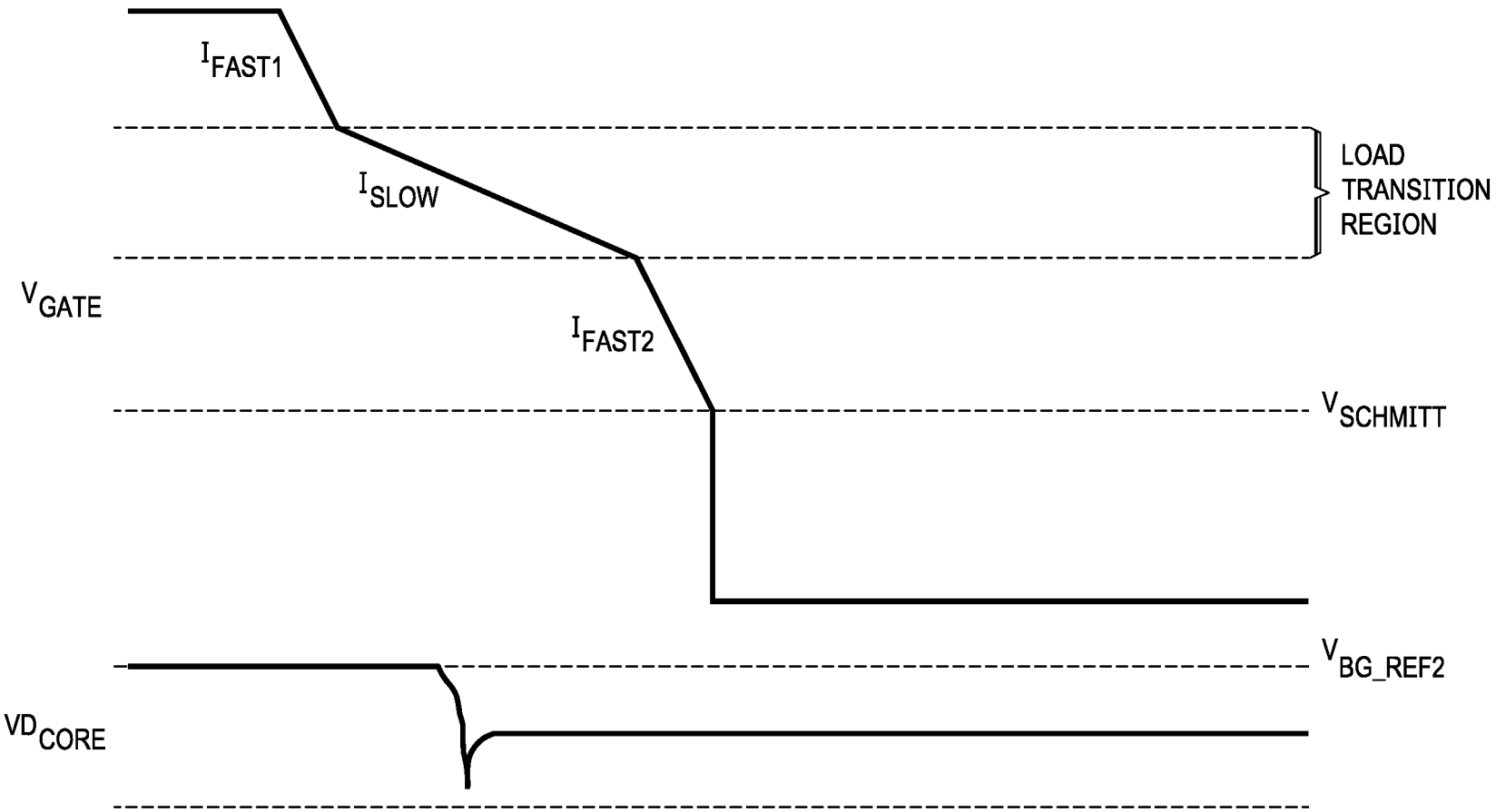
FIG. 6 illustrates graphs of example waveforms of a switch control signal and a rail voltage within the electronic device shown in FIG. 3 using the current-steering circuit of FIG. 5, in accordance with embodiments of the present disclosure.

FIG. 5 illustrates a circuit diagram of selected components of a current-steering circuit 500 which may be implemented by soft-open controller 134 for performing need-based soft-open and soft-close for supply switch 118, in accordance with embodiments of the present disclosure. FIG. 6 illustrates graphs of example waveforms of switch control signal $V_{GATE}$ and rail voltage $VD_{CORE}$ using current-steering circuit 500 of FIG. 5, in accordance with embodiments of the present disclosure. Current-steering circuit 500 may be configured to regulate a discharge rate of a capacitance coupled to the voltage node of switch control signal $V_{GATE}$ in order to implement a need-based soft open scheme. As shown in FIG. 5, current-steering circuit 500 may receive a switch enable signal SWITCH_EN as an input. Current-steering circuit 500 may include a soft-close subcircuit 502 and a soft-open subcircuit 504, both configured to regulate switch control signal $V_{GATE}$ based on conditions within electronic circuit 100. As shown in FIG. 5, soft-open portion 504 may include a voltage comparison portion 506 that generates a current $I_{FAST1}$, a current comparison portion 508 that generates a current $I_{FAST2}$, a constant pulldown portion 510 that generates a current $I_{SLOW}$, and a final fast pulldown portion 512 that generates a current $I_{SCHMITT}$. Circuit details of each subcircuit and portion are shown in FIG. 5 and not described in detail, as those of skill in the art should appreciate how the detailed circuitry accomplishes the functionality of each subcircuit and portion.

As shown in FIG. 6, current-steering circuit 500 may apply current $I_{FAST1}$ to discharge switch control signal $V_{GATE}$ when the following conditions are true:

(a) a higher external voltage $VD_{EXT}$, with supply switch 118 closed, has pulled rail voltage $VD_{CORE}$ higher than a predetermined reference voltage $V_{BG_REF2}$; and (b) rail voltage $VD_{CORE}$ has not started to decrease, which occurs right before a load transition, which may be indicated by internally-generated rail voltage $VD_{CORE}$ being greater than or equal to external voltage $VD_{EXT}$ generated by on-chip power supply 114.

As also shown in FIG. 6, current-steering circuit 500 may apply current $I_{FAST2}$ to discharge switch control signal $V_{GATE}$ when the following conditions are true:

(a) the load handover to on-chip power supply 114 has already occurred, which may be indicated by an indicator voltage $V_{LDO}$_SW being less than rail voltage $VD_{CORE}$; and (d) on-chip power supply 114 is not overshooting, as indicated by $VD_{CORE}$ being lower than or equal to predetermined reference voltage $V_{BG_REF2}$.

As further shown in FIG. 6, when the conditions for applying currents $I_{FAST1}$ and $I_{FAST2}$ are not met, current-steering circuit 500 may apply current $I_{SLOW}$ to discharge switch control signal $V_{GATE}$ in a load transition region. In addition, current-steering circuit 500 may apply current $I_{SCHMITT}$ to quickly discharge switch control signal $V_{GATE}$ in final pulldown at the end of the switching transition once switch control signal $V_{GATE}$ reaches a threshold voltage $V_{SCHMITT}$.

Figure 7:
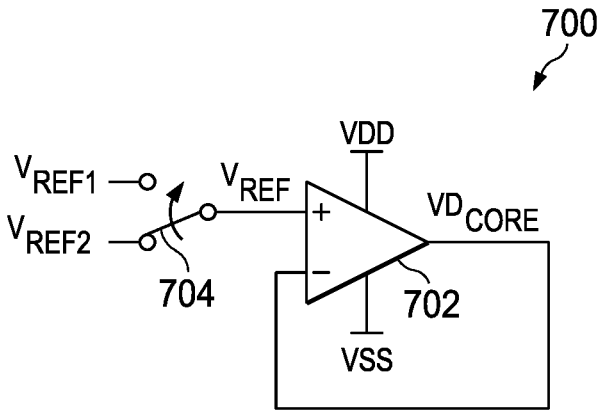
FIG. 7 illustrates selected components of an example LDO that may be implemented within an on-chip supply, in accordance with embodiments of the present disclosure.
Figure 8:
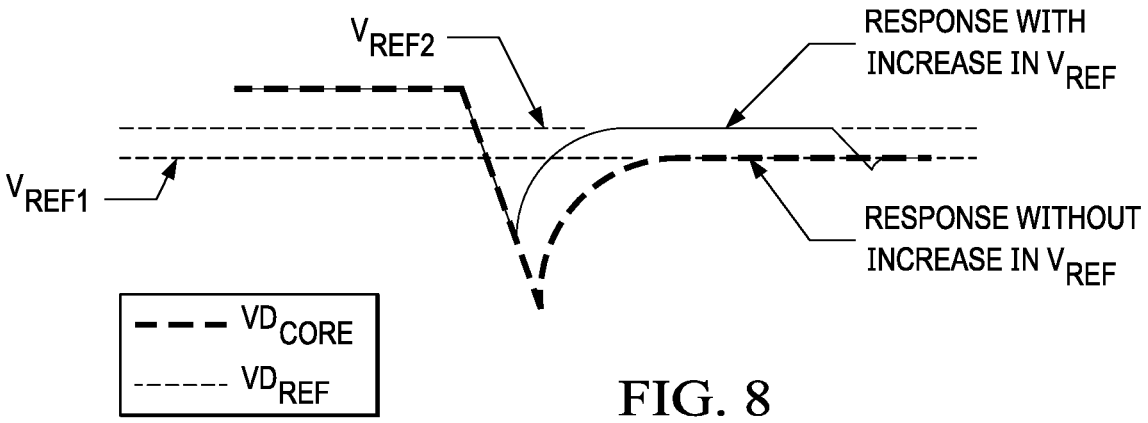
FIG. 8 illustrates graphs of example waveforms of a rail voltage and an internal reference voltage within the LDO shown in FIG. 7, in accordance with embodiments of the present disclosure.

As described above, supply sequencer 136 may reduce or eliminate undershoot and/or overshoot of voltage on on-chip power rail $VD_{CORE}$ in response to transitions of supply switch 118, and control circuit 130 may, via communication of a reference selection control signal REF_SEL and communication of supply parameters SUPPLY_PARAM to on-chip power supply 114, internally precondition on-chip power supply 114 based on knowledge of opening and closing events of supply switch 118. For example, FIG. 7 illustrates selected components of an example LDO 700 that may be implemented within on-chip power supply 114, in accordance with embodiments of the present disclosure. As shown in FIG. 7, LDO 700 may include an operational amplifier 702 configured to regulate rail voltage $VD_{CORE}$ in accordance with an internal reference voltage $V_{REF}$. As further shown in FIG. 7, LDO 700 may include a switch 704, under the control of reference selection control signal REF_SEL, configured to select internal reference voltage $V_{REF}$ from either of a first reference voltage $V_{REF1}$ and a second reference voltage $V_{REF2}$, wherein $V_{REF2}>V_{REF1}$. In operation, supply sequencer 136 may increase reference voltage Vii from first reference voltage $V_{REF1}$ to second reference voltage $V_{REF2}$ during transition of supply switch 118 in order to reduce an undershoot of rail voltage $VD_{CORE}$ below first reference voltage $V_{REF1}$, as shown in FIG. 8.

Figure 9:
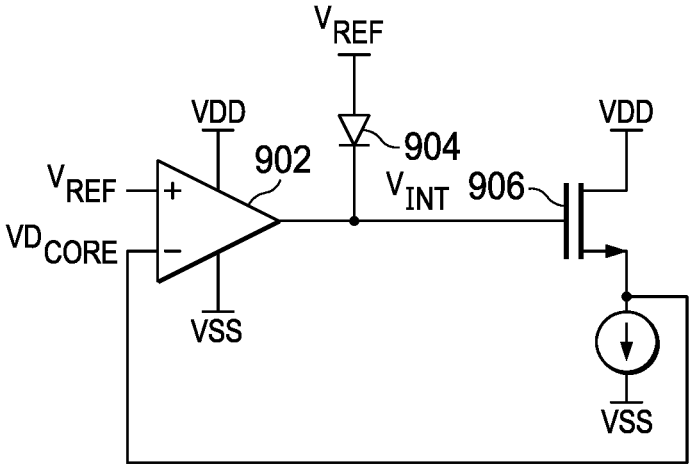
FIG. 9 illustrates selected components of another example LDO that may be implemented within an on-chip supply, in accordance with embodiments of the present disclosure.
Figure 10:
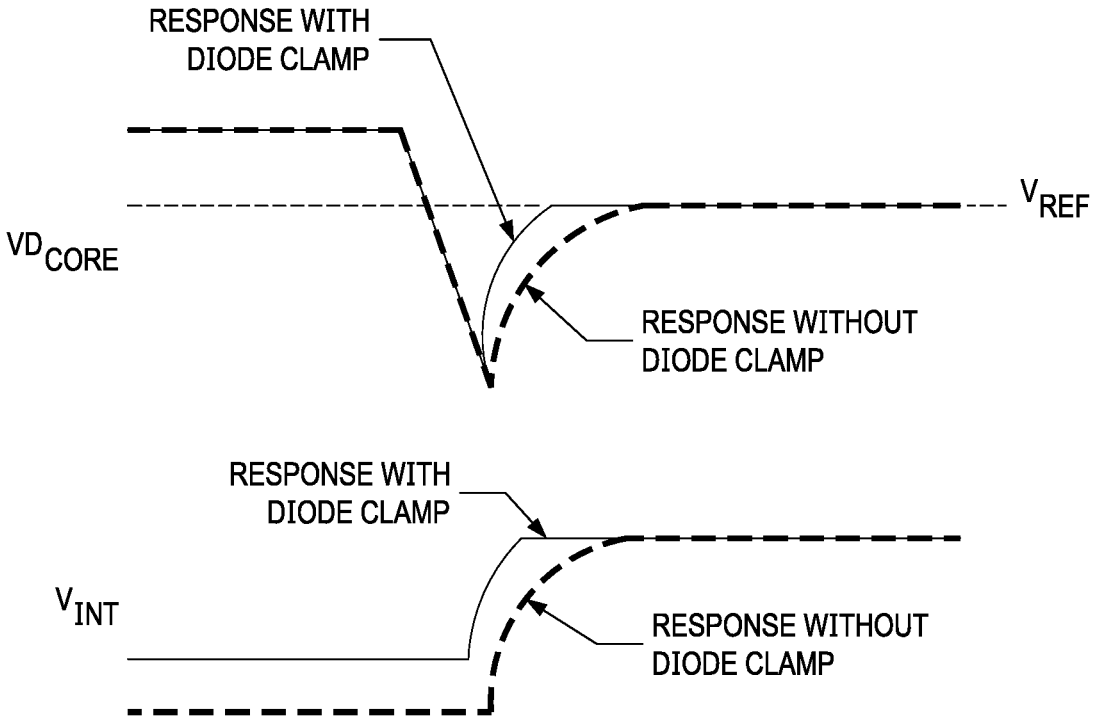
FIG. 10 illustrates graphs of example waveforms of a rail voltage and an internal voltage within the LDO shown in FIG. 9, in accordance with embodiments of the present disclosure.

As another example, FIG. 9 illustrates selected components of an example LDO 900 that may be implemented within on-chip power supply 114, in accordance with embodiments of the present disclosure. As shown in FIG. 9, LDO 900 may include an operational amplifier 902, diode clamp 904, and transistor 906 arranged as shown and configured to regulate rail voltage $VD_{CORE}$ in accordance with an internal reference voltage $V_{REF}$. In operation, diode clamp 904 may clamp an internal voltage $V_{INT}$ at the cathode of diode clamp 904 and gate terminal of transistor 906 to a minimum voltage, which in turn may reduce an undershoot of rail voltage $VD_{CORE}$ below first reference voltage $V_{REF1}$, as shown in FIG. 10.

In addition to using diode clamp 904 to prime internal nodes of LDO 900 in order to meet load demands, on-chip power supply 114 may include other mechanisms for priming internal nodes of LDO 900, including clamping a slowest moving electrical node, charging a gate of an output transistor to a constant predetermined value, increasing current to an output stage of LDO 900, and/or other suitable mechanisms.

In some embodiments, features of both LDO 700 of FIG. 7 and LDO 900 of FIG. 9 may be combined.

Figure 11:
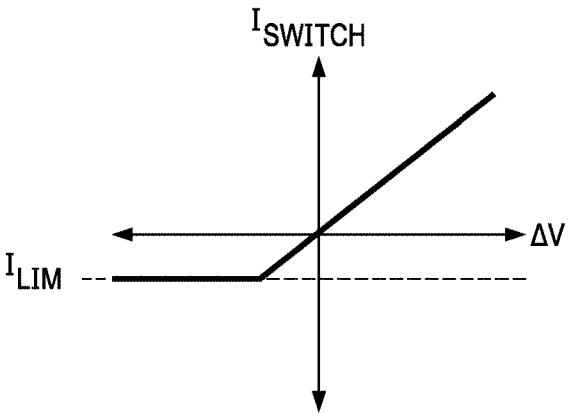
FIG. 11 illustrates an example transfer function of a current limit for a supply switch as a function of a voltage difference, in accordance with embodiments of the present disclosure.
Figure 12:
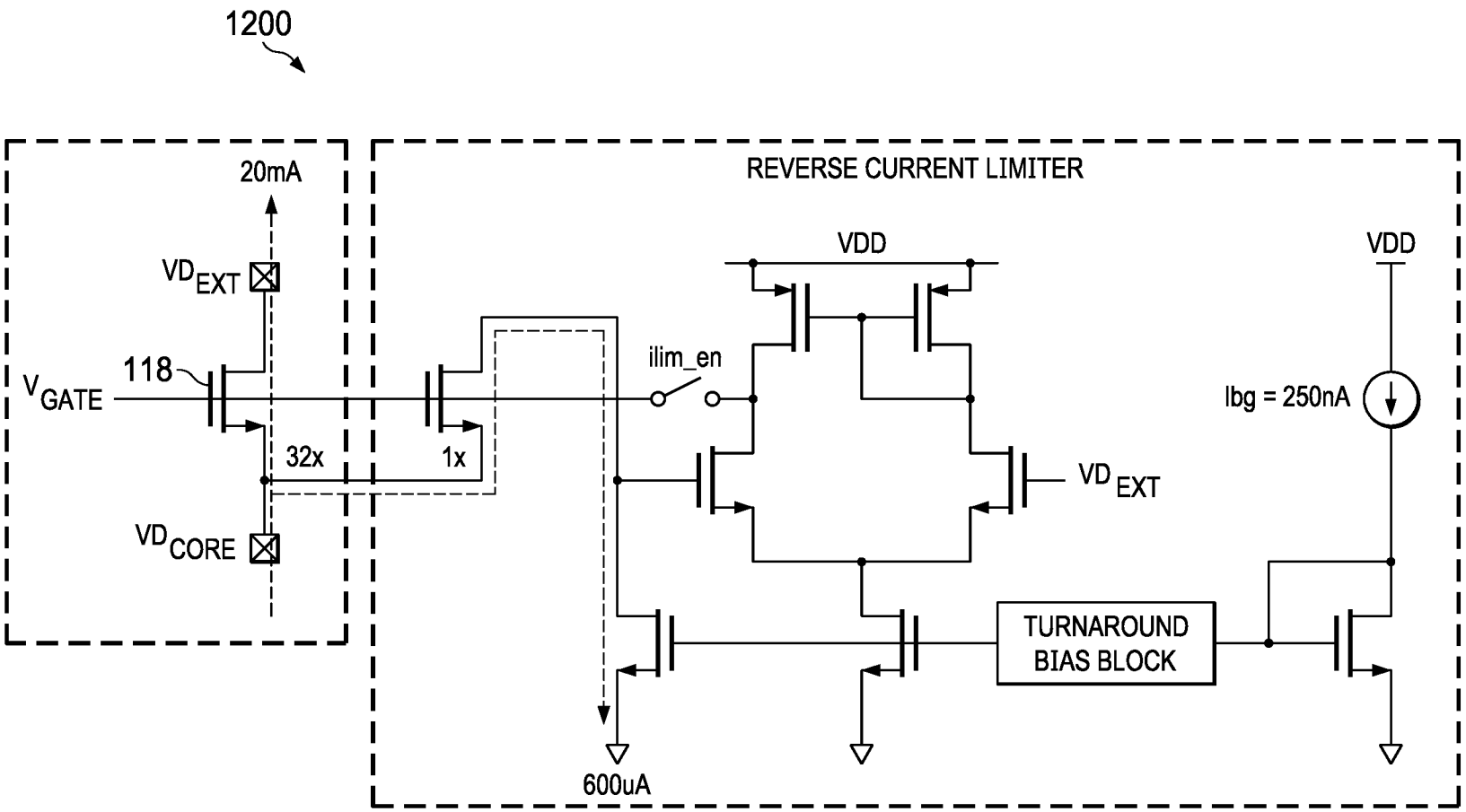
FIG. 12 illustrates a circuit diagram of selected components of a current-limiting circuit for performing the current-limiting shown in FIG. 11, in accordance with embodiments of the present disclosure.

As described above, to reduce or eliminate overshoot of voltage on on-chip power rail $VD_{CORE}$ in response to opening of supply switch 118 and/or to reduce or eliminate damage or reliability issues that may result from switch current $I_{SWITCH}$ exceeding a safe current limit, control circuit 130 may employ current limiter 132 to limit switch current $I_{SWITCH}$. For example, current limiter 132 may apply a current limit $I_{LIM}$ to switch current $I_{SWITCH}$ which is a function of a difference ΔV between external supply voltage $VD_{EXT}$ and rail voltage $VD_{CORE}$ (e.g., $\Delta V = VD_{EXT} - VD_{CORE}$) and the expected resistance of supply switch 132. FIG. 11 illustrates an example transfer function of current limit as a function of difference ΔV between external supply voltage $VD_{EXT}$ and rail voltage $VD_{CORE}$, in accordance with embodiments of the present disclosure. In the example shown in FIG. 11, when difference ΔV is negative and greater than a threshold magnitude, current limit $I_{LIM}$ may have a fixed maximum negative value. Current limiter 132 may implement current limiting in any suitable manner, including an analog feedback loop that drives a gate of supply switch 118 based on a measured difference ΔV across supply switch 118, or a mixed signal approach in which a fixed gate voltage $V_{GATE}$ is applied to limit switch current $I_{SWITCH}$ while rail voltage $VD_{CORE}$ is charging above. FIG. 12 illustrates a circuit diagram of selected components of a current-limiting circuit for performing the current-limiting shown in FIG. 11, in accordance with embodiments of the present disclosure. The circuit shown in FIG. 12 may limit switch current $I_{SWITCH}$ by comparing external supply voltage $VD_{EXT}$ against a sensor device (e.g., the n-type field-effect transistor labeled "1x" in FIG. 12) that mimics supply switch 118 (e.g., the n-type field-effect transistor labeled "32x" in FIG. 12) and that is biased with a current representative of the current limit $I_{LIM}$ (e.g., 600 μA).

Figure 13:
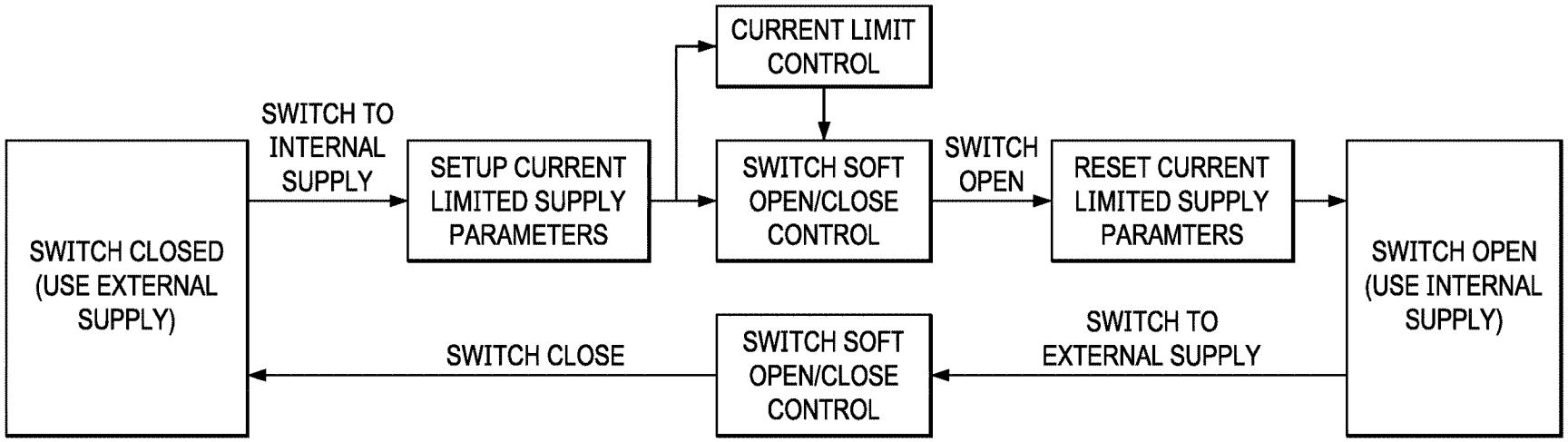
FIG. 13 illustrates an example state diagram for a supply sequencer, in accordance with embodiments of the present disclosure.

FIG. 13 illustrates an example state diagram for supply sequencer 136, in accordance with embodiments of the present disclosure. State sequencing of various components of electronic circuit 100 may be required to manage power transitions resulting from opening and/or closing of supply switch 118. The transition to rail voltage $VD_{CORE}$ being taken over by on-chip power supply 114 may require state variable initializations and current/switch gate control mechanisms to keep rail voltage $VD_{CORE}$ from collapsing. However, assuming that external power supply 116 is not current- or bandwidth-limited like on-chip power supply 114, not as much care may be needed when handing control of rail voltage $VD_{CORE}$ to external power supply 116. Nonetheless, in the event external power supply 116 is current- or bandwidth-limited, state sequencing mechanisms for transitioning supply switch 118 from opened to closed may be employed similar to those shown in FIG. 13 for transitioning supply switch 118 from closed to opened.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A system comprising:

an integrated circuit comprising an on-chip power supply and an internal power rail;

a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed; and a control circuit configured to:

monitor conditions associated with the on-chip power supply when the gate-controlled supply switch is transitioning between switch states; and based on the conditions, control a rate of charging or discharging of a capacitance coupled to a gate of the gate-controlled supply switch, wherein controlling the rate of charging or discharging of the capacitance comprises increasing the rate of discharging of the capacitance when a voltage generated by the on-chip power supply is above a load-dependent threshold voltage.

2. The system of claim 1, wherein the control circuit is configured to, prior to the gate-controlled supply switch transitioning between switch states, precondition internal nodes of the on-chip power supply.

3. The system of claim 1, wherein the control circuit is configured to regulate a load as seen by the on-chip power supply during transitioning of the gate-controlled supply switch by controlling a gate of the gate-controlled supply switch.

4. A system comprising:

an integrated circuit comprising an on-chip power supply and an internal power rail;

a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed; and a control circuit configured to:

monitor conditions associated with the on-chip power supply when the gate-controlled supply switch is transitioning between switch states; and based on the conditions, control a rate of charging or discharging of a capacitance coupled to a gate of the gate-controlled supply switch, wherein controlling the rate of charging or discharging of the capacitance comprises increasing the rate of discharging of the capacitance when a switch current through the gate-controlled supply switch is below a threshold current.

5. The system of claim 4, wherein the control circuit is configured to, prior to the gate-controlled supply switch transitioning between switch states, precondition internal nodes of the on-chip power supply.

6. The system of claim 4, wherein the control circuit is configured to regulate a load as seen by the on-chip power supply during transitioning of the gate-controlled supply switch by controlling a gate of the gate-controlled supply switch.

7. A system comprising:

an integrated circuit comprising an on-chip power supply and an internal power rail;

a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed; and a control circuit configured to:

monitor conditions associated with the on-chip power supply when the gate-controlled supply switch is transitioning between switch states; and based on the conditions, control a rate of charging or discharging of a capacitance coupled to a gate of the gate-controlled supply switch, wherein controlling the rate of charging or discharging of the capacitance comprises increasing the rate of discharging of the capacitance when a current generated by the on-chip power supply is above a threshold current.

8. The system of claim 7, wherein the control circuit is configured to, prior to the gate-controlled supply switch transitioning between switch states, precondition internal nodes of the on-chip power supply.

9. The system of claim 7, wherein the control circuit is configured to regulate a load as seen by the on-chip power supply during transitioning of the gate-controlled supply switch by controlling a gate of the gate-controlled supply switch.

10. A system comprising:

an integrated circuit comprising an on-chip power supply and an internal power rail;

a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed; and a control circuit configured to:

monitor conditions associated with the on-chip power supply when the gate-controlled supply switch is transitioning between switch states; and based on the conditions, control a rate of charging or discharging of a capacitance coupled to a gate of the gate-controlled supply switch, wherein controlling the rate of charging or discharging of the capacitance comprises increasing the rate of discharging of the capacitance when a gate voltage of the gate-controlled supply switch is below a threshold voltage.

11. The system of claim 10, wherein the control circuit is configured to, prior to the gate-controlled supply switch transitioning between switch states, precondition internal nodes of the on-chip power supply.

12. The system of claim 10, wherein the control circuit is configured to regulate a load as seen by the on-chip power supply during transitioning of the gate-controlled supply switch by controlling a gate of the gate-controlled supply switch.

13. A method, in a system comprising an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, the method comprising:

monitoring conditions associated with the on-chip power supply when the gate-controlled supply switch is transitioning between switch states; and based on the conditions, controlling a rate of charging or discharging of a capacitance coupled to a gate of the gate-controlled supply switch, wherein controlling the rate of charging or discharging of the capacitance comprises increasing the rate of discharging of the capacitance when a voltage generated by the on-chip power supply is above a load-dependent threshold voltage.

14. The method of claim 13, further comprising, prior to the gate-controlled supply switch transitioning between switch states, preconditioning internal nodes of the on-chip power supply.

15. The method of claim 13, further comprising regulating a load as seen by the on-chip power supply during transitioning of the gate-controlled supply switch by controlling a gate of the gate-controlled supply switch.

16. A method, in a system comprising an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, the method comprising:

monitoring conditions associated with the on-chip power supply when the gate-controlled supply switch is transitioning between switch states; and based on the conditions, controlling a rate of charging or discharging of a capacitance coupled to a gate of the gate-controlled supply switch, wherein controlling the rate of charging or discharging of the capacitance comprises increasing the rate of discharging of the capacitance when a switch current through the gate-controlled supply switch is below a threshold current.

17. The method of claim 16, further comprising, prior to the gate-controlled supply switch transitioning between switch states, preconditioning internal nodes of the on-chip power supply.

18. The method of claim 16, further comprising regulating a load as seen by the on-chip power supply during transitioning of the gate-controlled supply switch by controlling a gate of the gate-controlled supply switch.

19. A method, in a system comprising an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, the method comprising:

monitoring conditions associated with the on-chip power supply when the gate-controlled supply switch is transitioning between switch states; and based on the conditions, controlling a rate of charging or discharging of a capacitance coupled to a gate of the gate-controlled supply switch, wherein controlling the rate of charging or discharging of the capacitance comprises increasing the rate of discharging of the capacitance when a current generated by the on-chip power supply is above a threshold current.

20. The method of claim 19, further comprising, prior to the gate-controlled supply switch transitioning between switch states, preconditioning internal nodes of the on-chip power supply.

21. The method of claim 19, further comprising regulating a load as seen by the on-chip power supply during transitioning of the gate-controlled supply switch by controlling a gate of the gate-controlled supply switch.

22. A method, in a system comprising an integrated circuit comprising an on-chip power supply and an internal power rail and a gate-controlled supply switch configured to be coupled between the on-chip power supply and an external power supply such that the internal power rail is regulated by the on-chip power supply when the gate-controlled supply switch is open and the internal power rail is regulated by the external power supply when the gate-controlled supply switch is closed, the method comprising:

monitoring conditions associated with the on-chip power supply when the gate-controlled supply switch is transitioning between switch states; and based on the conditions, controlling a rate of charging or discharging of a capacitance coupled to a gate of the gate-controlled supply switch, wherein controlling the rate of charging or discharging of the capacitance comprises increasing the rate of discharging of the capacitance when a gate voltage of the gate-controlled supply switch is below a threshold voltage.

23. The method of claim 22, further comprising, prior to the gate-controlled supply switch transitioning between switch states, preconditioning internal nodes of the on-chip power supply.

24. The method of claim 22, further comprising regulating a load as seen by the on-chip power supply during transitioning of the gate-controlled supply switch by controlling a gate of the gate-controlled supply switch.

* * * * *